US008361236B2

(12) United States Patent
Duan et al.

(10) Patent No.: US 8,361,236 B2
(45) Date of Patent: Jan. 29, 2013

(54) SUPRAMOLECULAR COMPLEX FLAVOR IMMOBILIZING FOR CONTROLLED RELEASE OF FLAVOR IN SMOKING ARTICLES

(75) Inventors: Biao Duan, Appleton, WI (US); Munmaya K. Mishra, Manakin Sabot, VA (US); Peter J. Lipowicz, Midlothian, VA (US); Shengsheng Liu, Henrico, VA (US)

(73) Assignee: Philip Morris USA Inc., Richmond, VA (US)

( * ) Notice: Subject to any disclaimer, the term of this patent is extended or adjusted under 35 U.S.C. 154(b) by 648 days.

(21) Appl. No.: 12/577,024

(22) Filed: Oct. 9, 2009

(65) Prior Publication Data

US 2011/0083678 A1 Apr. 14, 2011

(51) Int. Cl.
*A24B 15/30* (2006.01)

(52) U.S. Cl. ..... 131/276; 131/274; 131/275

(58) Field of Classification Search ..... 131/274–276
See application file for complete search history.

(56) References Cited

U.S. PATENT DOCUMENTS

| | | | | |
|---|---|---|---|---|
| 4,212,310 | A | 7/1980 | Van Auken et al. | |
| 4,862,905 | A | 9/1989 | Green, Jr. et al. | |
| 4,966,171 | A | 10/1990 | Serrano et al. | |
| 5,144,964 | A | 9/1992 | Demain | |
| 5,261,423 | A | 11/1993 | Gaudlitz et al. | |
| 5,499,636 | A | 3/1996 | Baggett, Jr. et al. | |
| 5,666,976 | A | 9/1997 | Adams et al. | |
| 5,692,525 | A | 12/1997 | Counts et al. | |
| 5,692,526 | A | 12/1997 | Adams et al. | |
| 5,915,387 | A | 6/1999 | Baggett, Jr. et al. | |
| 5,988,176 | A | 11/1999 | Baggett, Jr. et al. | |
| 6,026,820 | A | 2/2000 | Baggett, Jr. et al. | |
| 6,761,174 | B2 | 7/2004 | Jupe et al. | |
| 2005/0241656 | A1 | 11/2005 | Kennison | |
| 2007/0267033 | A1 | 11/2007 | Mishra et al. | |
| 2008/0017206 | A1 | 1/2008 | Becker et al. | |
| 2008/0302376 | A1 * | 12/2008 | Karles et al. | 131/275 |
| 2009/0022856 | A1 | 1/2009 | Cheng et al. | |
| 2011/0083679 | A1 | 4/2011 | Liu et al. | |

FOREIGN PATENT DOCUMENTS

GB 1412878 A 11/1975

OTHER PUBLICATIONS

Simon et al., "Thermoanalytical Study of O,O'-Dibenzoyl-(2*R*, 3*R*)-Tartaric Acid SMC Part IV. SMC formation in melt," *Journal of Thermal Analysis and Calorimetry*, 2004, pp. 787-793, vol. 75, Akademiai Kiado, Budapest, Hungary.

International Preliminary Report on Patentability issued Apr. 11, 2012 for PCT/EP2010/006103.

U.S. Appl. No. 13/072,126, filed Mar. 25, 2011.

International Search Report and Written Opinion mailed Mar. 14, 2011 for PCT/EP2010/006103.

Kassai, Csaba et al., "Optical Resolution of Racemic Alcohols via Diastereoisomeric Supramolecular Compound Formation with O,O'-Dibenzoyl-(2R,3R)-tartaric Acid", Tetrahedron Elsevier Science Publishers, Amsterdam, NL, vol. 56, No. 42, Oct. 13, 2000, pp. 8355-8359.

* cited by examiner

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A smokable composition includes (a) a smokable material; and (b) a supramolecular assembly. The supramolecular assembly comprises a flavorant and at least one selected from the group consisting of O,O'-dibenzoyl-(2R,3R)-tartaric acid, a hydrate thereof or a salt thereof, and ditoluoyl-(2R,3R)-tartaric acid, a hydrate thereof or a salt thereof. In addition, a smoking article comprises a rod of tobacco or tobacco substitute, optionally a filter attached to the rod, and the supramolecular assembly, as menthol-release agent.

15 Claims, 2 Drawing Sheets

SUPRAMOLECULAR COMPLEX FLAVOR IMMOBILIZING FOR CONTROLLED RELEASE OF FLAVOR IN SMOKING ARTICLES

SUMMARY

According to one embodiment is provided a smokable composition that comprises:

(a) a smokable material; and (b) a supramolecular assembly, wherein the supramolecular assembly comprises a flavorant and at least one of O,O'-dibenzoyl-(2R,3R)-tartaric acid, a hydrate thereof, a salt thereof, ditoluoyl-(2R,3R)-tartaric acid, a hydrate thereof, a salt thereof, or combinations of these.

According to another embodiment is provided a smoking article that comprises:

(a) a rod of tobacco or tobacco substitute;

(b) optionally a filter attached to the rod; and (c) the supramolecular assembly, wherein the supramolecular assembly comprises a flavorant and at least one of O,O'-dibenzoyl-(2R,3R)-tartaric acid, a hydrate thereof, a salt thereof, ditoluoyl-(2R,3R)-tartaric acid, a hydrate thereof, a salt thereof, or combinations of these.

According to yet another embodiment, a method for control-releasing flavor comprises:

(a) incorporating the supramolecular assembly that comprises a flavorant and at least one of O,O'-dibenzoyl-(2R,3R)-tartaric acid, a hydrate thereof, a salt thereof, ditoluoyl-(2R,3R)-tartaric acid, a hydrate thereof, a salt thereof, or combinations of these into a smoking article; and (b) releasing a flavorant from the supramolecular assembly.

In the smoking article described herein, the flavorant is immobilized, and thus immigration of the flavorant, prior to use, can be significantly reduced.

DETAILED DESCRIPTION

Figure 1A:
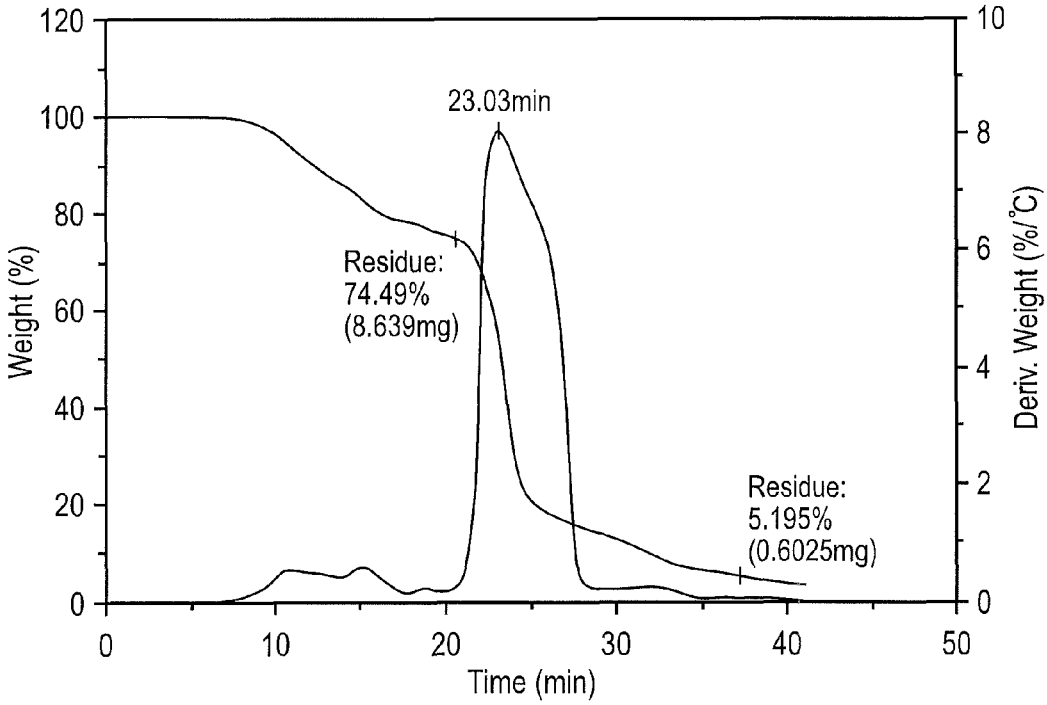
FIGS. 1A and 1B show a thermogravimetric analysis (TGA)/mass spectroscopy (MS) plot of a supramolecular assembly formed from (−)-menthol and O,O'-dibenzoyl-(2R,3R)-tartaric acid monohydrate.

Smoking articles, such as cigarettes, generally have a substantially cylindrical rod shaped structure which typically includes a roll or column of smokable material, such as shredded tobacco, surrounded by a paper wrapper. Many types of cigarettes may have a cylindrical filter portion aligned in an end-to-end relationship with the tobacco rod. The filter portion may comprise one or more plugs formed from a cellulose acetate tow circumscribed by a paper material known as "plug wrap" thereby forming a "filter plug." Typically, the filter portion can be attached to one end of the tobacco rod using a circumscribing wrapping material known as "tipping paper."

Additives such as flavorants can be added to smoking articles to provide desirable organoleptic sensations. Menthol is a popular flavorant due to its mint flavoring and cooling effects that can be imparted to tobacco smoke. However, menthol has a relatively high volatility, which can cause it to vaporize and gradually escape from the smoking articles during handling and storage; as a result, retaining the concentration of menthol in smoking articles can be difficult.

Sorbent materials can be employed in smoking articles to remove targeted constituents from tobacco smoke by means of absorption, adsorption and/or other means into or onto the sorbent. Examples of sorbent materials include carbon, particularly, activated carbons.

While sorbents are effective in removing targeted constituents from tobacco smoke, they can also sorb flavorants, such as menthol, present in the smoking article. This sorption of flavorants can reduce the level of flavoring that is available to the user of the smoking article. In addition, sorption of flavorant by the sorbent can also reduce the sorption capacity of the sorbent. Sorption of the flavorant can deactivate the sorbent as the sorbed flavorants fill available sorbent sites within the sorbent.

Accordingly, there is interest in providing additives, in particular, relatively volatile flavorants such as menthol, wherein the additives can be prevented from migrating and losses, prior to use of the smoking articles.

As used herein, the phrases "a supramolecular assembly" and "a supramolecular complex," also referred to as a clathrate, inclusion compound and 'host-guest' assembly, are a multi-component system of atoms, ions and/or molecules, which are held together by non-covalent interactions such as hydrogen bonds, van der Waals forces, $\pi$-$\pi$ interactions and/or electrostatic effects. These expressions may be used interchangeably herein.

When using the host-guest nomenclature to describe such a supramolecular assembly, the larger compound can generally be described as the "host" compound, and the smaller compound can be described as the "guest" compound. The "host" molecule typically may not be volatile and can often be a large molecule. In the present context, the flavorant compounds can be "guest" compounds, while the larger compounds can be "host" compounds.

A flavorant can be a chemical compound which provides a desirable flavor or scent. By forming a supramolecular assembly, a flavorant molecule such as a menthol molecule is attached to a host molecule via non-covalent interactions, and thus can not freely migrate. The supramolecular assembly can release the flavorant molecule only when the non-covalent interactions therein are disrupted by appropriate means. As a result, flavor migration and losses during handling and storage of smokable compositions or smoking articles can be reduced or prevented.

Any flavorant compound which can form a supramolecular assembly and be released upon exposure to appropriate conditions without decomposition may be used. Preferably, the flavorant compound contains one or more hydroxyl or aldehydic groups. Examples of suitable flavorant compounds include, but are not limited to, vanillin, linalool, menthol, guaicol, thymol, coumarin, eugenol, cinnamaldehyde and geraniol. These flavorant compounds may be used individually or in combination thereof.

O,O'-Dibenzoyl-(2R,3R)-tartaric acid (DBTA) forms a supramolecular assembly with (−)-menthol but not (+)-menthol and thus can be used as a host compound for (−)-menthol. Either (−)-menthol or a racemic mixture of menthol containing an equal amount of (−)-menthol and (+)-menthol can be used in formation of a supramolecular assembly with DBTA.

In this supramolecular assembly, the molar ratio of DBTA and (−)-menthol is 1:1. Although not wishing to be bound to any theory, it is believed that the hydroxyl groups and the phenyl rings in DBTA interact with the hydroxyl group and the methyl groups in (−)-menthol to form hydrogen bonds and likely other non-covalent bonds, thereby forming a supramolecular assembly of DBTA and (−)-menthol. This process may be exemplified below:

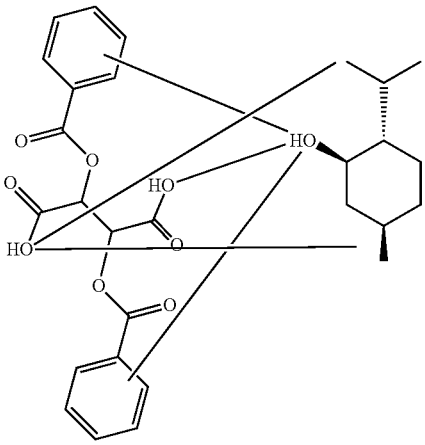

A supramolecular assembly of DBTA and (−)-menthol can be prepared by any suitable method. For example, (−)-menthol (or racemic menthol) and DBTA monohydrate fine powder can be mixed in a 1:1 molar ratio and the mixture can be gently heated on a water bath to form a generally clear melt. The melt can solidify upon cooling to room temperature and stirring, thereby forming the supramolecular assembly. The resulting supramolecular assembly can be used directly without further treatment, or may be further purified, for example, by recrystallization, prior to use. In a modified process, (−)-menthol may be used in excess to attain substantially complete conversion of DBTA to the supramolecular assembly, and thereafter, any excess menthol may be removed under reduced pressure.

In one embodiment, the supramolecular assembly can be admixed with an appropriate polymer binder and formed into a desired shape, i.e., beads, tablets, rods, etc. Examples of suitable polymer binders include, but are not limited to, microcrystalline cellulose (MCC), carboxymethyl cellulose (CMC) and polycarbonates. Preferably, supramolecular assemblies, either in their pure form or combined with a binder therefor, are preserved in dry airtight packages prior to use.

Other DBTA derivatives which can also be used as host molecules for flavorant compounds such as menthol includes, but are not limited to, O,O'-ditoluoyl-(2R,3R)-tartaric acid (DTTA). In addition, the hydrates of DBTA and DTTA such as monohydrates thereof, and salts thereof can also be suitable host compounds. These compounds may be used individually or in combination thereof.

Since various non-covalent interactions between a host molecule and a guest molecule are far weaker than covalent bonding (i.e., the kind of bonds which hold atoms in a molecule together), a supramolecular assembly can usually be far less stable than a molecular compound. For example, a supramolecular assembly can be more susceptible to breaking apart at high temperatures or when exposed to conditions which disrupt the weak bonding that hold the complex together. These conditions may include acidic or alkaline conditions, hydrolysis and solvation, which can disrupt the hydrogen bonding of the supramolecular complexes.

In the present context, no smell of menthol was detected from a supramolecular assembly of DBTA and (−)-menthol at ambient temperature. Further, when a small amount of a supramolecular assembly of DBTA and (−)-menthol was added to tap water at ambient temperature, no evolution of menthol was detected. On the other hand, when a small amount of the supramolecular assembly was added to hot water at about 80° C., evolution of menthol was instantly detected by its distinct smell and continued for hours.

Figure 1B:
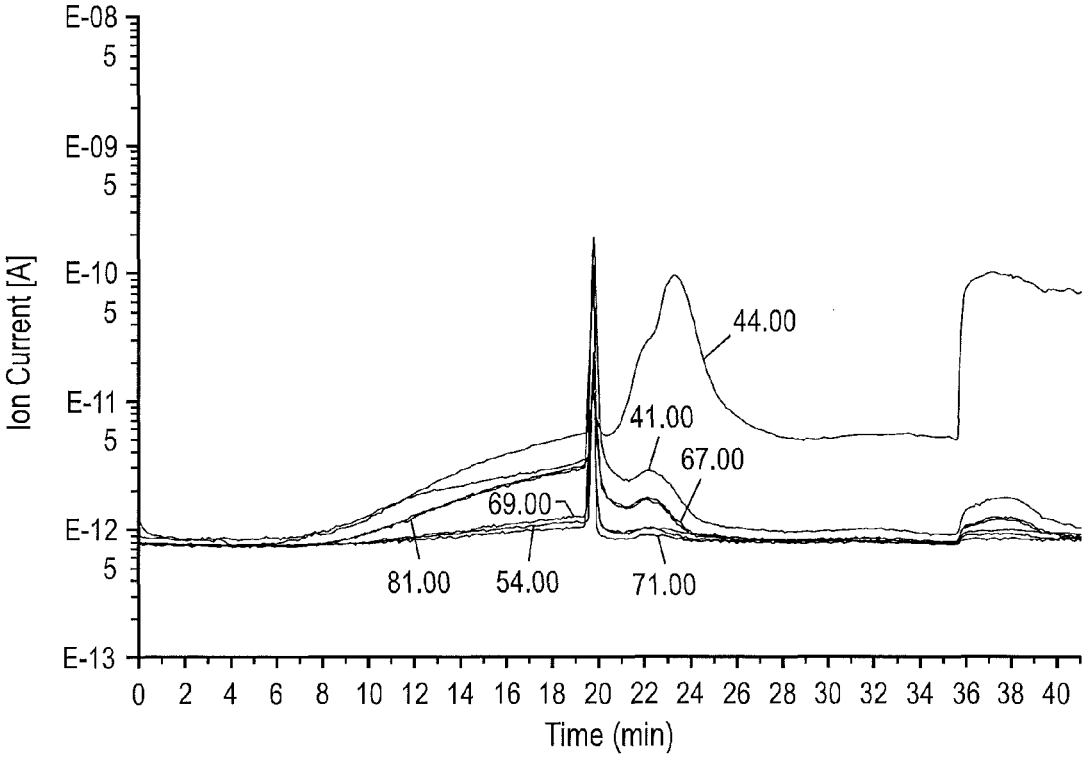
Figure 2:
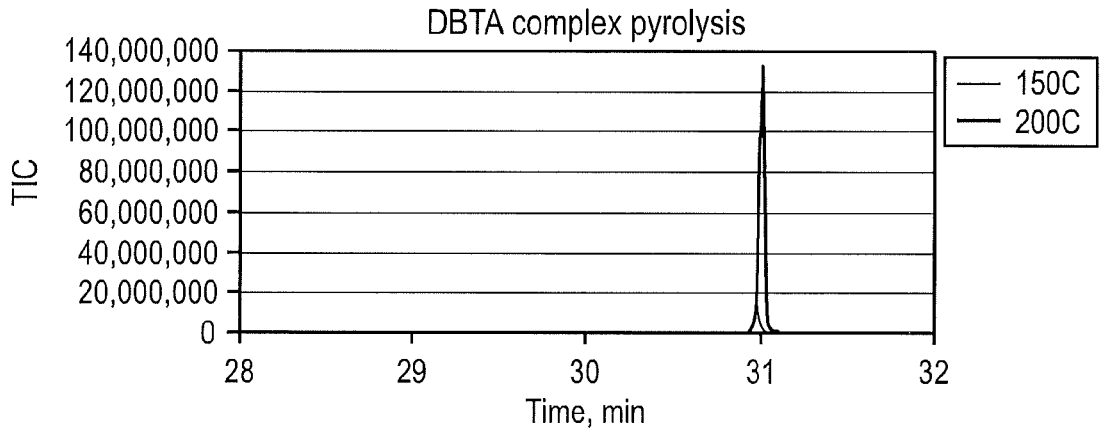
FIG. 2 is a gas chromatograph (GC)/mass spectroscopy (MS) plot of a supramolecular assembly formed from (−)-menthol and O,O'-dibenzoyl-(2R,3R)-tartaric acid monohydrate.

In addition, when the supramolecular assembly of DBTA and (−)-menthol was subjected to heating, menthol release was detected by both thermo gravimetric analysis (TGA)/mass spectroscopy (MS) (FIG. 1) and gas chromatograph (GC)/MS (FIG. 2).

FIGS. 1A and 1B shows that there was little weight change (i.e., menthol release) of the supramolecular assembly in the first 10 minutes. Weight loss occurred gradually from about 10 minutes to about 20 minutes and rapidly from about 20 minutes to about 25 minutes. At 22.03 minutes, weight loss reached peak rate of about 8%/° C. Based on the TGA/MS results, about 26% (calculated value: 29%) of the supramolecular assembly thermolysis products is menthol.

Further, as shown in FIG. 2, the supramolecular assembly releases (−)-menthol at 150° C. and 200° C. without any detectable by-products.

The supramolecular assembly described herein can be incorporated into a smokable material to produce a smokable composition for smoking articles. The smokable material may include either tobacco (i.e., cut filler, tobacco powder, etc.) or tobacco substitute materials (i.e., vegetable or plant products like shredded lettuce), or mixtures or combinations thereof. Examples of suitable types of tobacco materials may include, but are not limited to, flue-cured tobacco, Burley tobacco, Maryland tobacco, Oriental tobacco, rare tobacco, specialty tobacco, reconstituted tobacco, agglomerated tobacco fines, blends thereof and the like. Preferably, the tobacco or tobacco substitute is pasteurized. Some or all of the tobacco material may be fermented.

The supramolecular assembly may be incorporated in smokable composition in accordance with any appropriate methods. For example, the supramolecular assembly may be dissolved or dispersed in an appropriate solvent and applied to smokable material, e.g., by spraying, during preparation of a smokable composition. Alternatively, the supramolecular assembly powders may be admixed with smokable material.

Further, the tobacco or tobacco substitute may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used.

In one embodiment, the supramolecular assembly described herein can be incorporated into a smoking article. As used herein, the term "smoking article" is intended to include cigarettes, cigars, pipes and the like. In particular, the smoking article can be a traditional or non-traditional lit-end cigarette comprising a tobacco rod and a filter attached thereto. Non-traditional cigarettes include, but are not limited to, cigarettes for electrical smoking systems as described in commonly-assigned U.S. Pat. Nos. 6,026,820; 5,988,176; 5,915,387; 5,692,526; 5,692,525; 5,666,976; and 5,499,636.

Other non-traditional cigarettes include those having a fuel element in the tobacco rod as described in U.S. Pat. No. 4,966,171.

When the supramolecular assembly is contained into a smoking articles such as cigarettes, having a rod of tobacco or tobacco substitutes and optionally a filter attached to the rod, it can be incorporated within the rod, within the filter element, and/or at or near the rod/filter element interface of a smoking article. Under smoking conditions, the supramolecular assembly can release the immobilized flavorant such as menthol by directly or indirectly heating within the rod and/or the filter through which moist steam from the burning tobacco stick is pulled.

When the smoking article is a cigarette, the supramolecular assembly can also be incorporated into or printed onto wrapping materials for the filter, the rod or both the filter and the rod, which may further enhance sidestream smoke flavor and aroma under smoking conditions.

Figure 3:
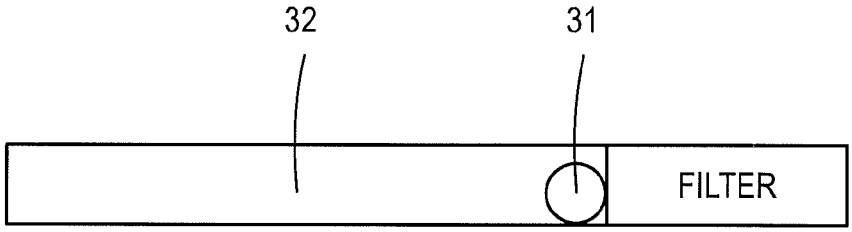
FIG. 3 is an illustration of an exemplary cigarette comprising a filter, a rod of tobacco or tobacco substitute and a supramolecular assembly located toward the downstream end of the rod.

Preferably, the supramolecular assembly can be placed within the rod of tobacco or tobacco substitute and toward the downstream end of the tobacco rod. This can be achieved by one of various means. For example, a small solid unit of the supramolecular assembly, either in its pure form or in conjunction with a carrier therefor, can be placed at the very downstream end of the tobacco rod of a smoking article. FIG. 3 shows an exemplary cigarette having a supramolecular assembly 31 in the form of a small circular tablet located within the tobacco rod 32 and toward the downstream end of the tobacco rod 32.

Alternatively, a band of paper which is incorporated therein, or coated with, the supramolecular assembly, can be applied toward the downstream end of a rod and prior to the filter of a smoking article such as a cigarette. In addition, a portion of smoking materials can be mixed with the supramolecular assembly and then incorporated into a rod of tobacco or tobacco substitute toward the downstream end of the rod.

When the supramolecular assembly is present in the downstream end of the tobacco rod of a smoking article, release of the flavor can be enhanced toward the last puffs and hence, provide consumers with refreshing aroma finish.

The amount of the supramolecular assembly incorporated in smoking articles may be varied depending on the type of flavorant and smokable material used, and desired flavor experience.

Further, a smokable composition or smoking article may contain two or more supramolecular assemblies comprising different flavorants.

The filter for smoking articles disclosed herein may include at least one sorbent material and filter material. The filter material for can be any of a variety of fibrous materials generally suitable for use in tobacco smoke filters. Typical fibrous materials include cellulose acetate (CA), polypropylene and paper. Preferably, the filter material comprises cellulose acetate fibers. A "sorbent," as used herein, is a material which removes targeted constituents from tobacco smoke by means of "sorption," which, as used herein, includes absorption, adsorption and any other mechanism by which a targeted constituent is immobilized on the sorbent. Any appropriate adsorbent and/or absorbent materials may be used as the sorbent. Examples of suitable sorbents include, but are not limited to, carbons such as activated carbon, graphite and charcoal, aluminas, silicates, molecular sieves, zeolites, metal particles and polymeric materials. These sorbents may be used individually or in combination thereof. Preferably, the sorbent comprises carbon.

The sorbent-containing filter plug for filter may be manufactured using any appropriate method. For example, a sorbent material may be dispersed in an appropriate solvent, and then applied to fibrous filter material, e.g., by spraying or dipping. Alternatively, a solid sorbent material may be blended with filter material to form a solid mixture. The amount of the sorbent incorporated onto the filter material may vary and may depend on the type of sorbent and filter material used. The resulting sorbent-containing filter material can then be formed into the desirable shape (generally, a cylindrical plug), wrapped with plug wrap, and cut into the necessary length to form a sorbent-containing filter plug.

Any other additives typically contained in smoking articles can also be suitably incorporated into the smoking article described herein.

The supramolecular assembly described herein can release the immobilized flavorant, e.g., by heating or contacting the supramolecular assembly with water at an elevated temperature, for example, about 80° C. or higher.

Specific examples of processes for producing a supramolecular assembly comprising O,O'-dibenzoyl-L-tartaric acid monohydrate (DBTA)-L-menthol are provided below.

EXAMPLE 1

L-menthol (15.6 g, 0.10 mol) was mixed with O,O'-dibenzoyl-L-tartaric acid monohydrate (DBTA, 37.7 g, 0.10 mol) in a 200 mL beaker. The mixture was gently heated, with magnetic stirring, in an oil bath to 105° C. for about 2 to 3 hours until a clear melt was formed. The melt solidified after cooling down to room temperature to afford O,O'-dibenzoyl-L-tartaric acid monohydrate (DBTA)-L-menthol complex.

The resulting solid product was ground into powder which was then suspended in 50 mL hexane. The filtered powder was washed by hexane (50 mL×2) and air-dried in hood, to provide 52.1 g of the final product (yield: 97.7%).

EXAMPLE 2

3.41 kg of L-menthol was mixed with 8.25 kg of O,O'-dibenzoyl-L-tartaric acid monohydrate (DBTA) by mechanic stirring. The resulting mixture was heated in a heating mantle at a rate of approximately 0.5° C. per minute until a clear melt was formed (about 100° C.). At this stage, stirring was stopped and the reaction vessel was removed from the heating mantle. The melt was allowed to cool to room temperature to obtain solid O,O'-dibenzoyl-L-tartaric acid monohydrate (DBTA)-L-menthol complex.

EXAMPLE 3

L-menthol (2.4 g, 15 mmol) was mixed with DBTA powder (5.8 g, 15 mmol) in 30 mL hexane and stirred for about 3 to 7 days. The filtrated solid powder O,O'-dibenzoyl-L-tartaric acid monohydrate (DBTA)-L-menthol complex product was dried in vacuum and ready for use.

EXAMPLE 4

L-menthol (2.4 g, 15 mmol) and DBTA (5.8 g, 15 mmol) were dissolved in 30 mL ethanol. The ethanol was allowed to evaporate naturally in fume-hood to obtain crystal O,O'-dibenzoyl-L-tartaric acid monohydrate (DBTA)-L-menthol complex product.

EXAMPLE 5

L-menthol (1.56 g, 10 mmol) and DBTA (3.76 g, 10 mmol) were dissolved in 30 mL acetone. Most of the acetone was allowed to evaporate in hood and the resulting mixture was further dried in vacuum.

EXAMPLE 6

L-menthol (1.56 g, 10 mmol) and DBTA (3.76 g, 10 mmol) were dissolved in 25 mL methylene chloride. The methylene chloride was allowed to evaporate naturally in fume-hood to obtain crystal O,O'-dibenzoyl-L-tartaric acid monohydrate (DBTA)-L-menthol complex product.

While various embodiments have been described with reference to specific embodiments, variations and modifications may be made without departing from the spirit and the scope of the invention. Such variations and modifications are to be considered within the purview and scope of the invention as defined by the appended claims.

All of the above-mentioned references are herein incorporated by reference in their entirety to the same extent as if each individual reference was specifically and individually indicated to be incorporated herein by reference in its entirety.

The invention claimed is:

1. A smokable composition comprising:

(a) a smokable material; and (b) a supramolecular assembly, wherein the supramolecular assembly comprises a flavorant and at least one selected from the group consisting of O,O'-dibenzoyl-(2R,3R)-tartaric acid, a hydrate thereof or a salt thereof, and ditoluoyl-(2R,3R)-tartaric acid, a hydrate thereof or a salt thereof.

2. The smokable composition of claim 1, wherein the flavorant is at least one selected from the group consisting of vanillin, linalool, menthol, guaicol, thymol, coumarin, eugenol, cinnamaldehyde and geraniol.

3. The smokable composition of claim 1, wherein the flavorant comprises (−)-menthol.

4. A smoking article comprising:

(a) a rod of tobacco or tobacco substitute;

(b) optionally a filter attached to the rod; and (c) a supramolecular assembly, wherein the supramolecular assembly comprises a flavorant and at least one selected from the group consisting of O,O'-dibenzoyl-(2R,3R)-tartaric acid, a hydrate thereof or a salt thereof, and ditoluoyl-(2R,3R)-tartaric acid, a hydrate thereof or a salt thereof.

5. The smoking article of claim 4, wherein the supramolecular assembly is present within the rod, within the filter, and/or at or near the rod/filter element interface.

6. The smoking article of claim 4, wherein the smoking article is a cigarette and the supramolecular assembly is present within the rod or in a paper wrapper thereof, within the filter or in a paper wrapper thereof, and/or at or near the rod/filter element interface.

7. The smoking article of claim 4, wherein the supramolecular assembly is present within the rod and toward the downstream end of the rod.

8. The smoking article of claim 4, wherein the filter comprises a sorbent.

9. The smoking article of claim 8, wherein the sorbent comprises at least one selected from the group consisting of at least one sorbent selected from the group consisting of carbons, aluminas, silicates, molecular sieves, polymeric materials, zeolites and metal particles.

10. The smoking article of claim 8, wherein the sorbent comprises active carbon.

11. A method for preparing the smoking article of claim 4, comprising:

(a) preparing a supramolecular assembly; and (b) incorporating the supramolecular assembly into a smoking article.

12. The method of claim 11, wherein the smoking article is a cigarette.

13. A method for control-releasing flavor comprising:

(a) incorporating a supramolecular assembly into a smoking article; and (b) releasing a flavorant from the supramolecular assembly, wherein the supramolecular assembly comprises the flavorant and at least one selected from the group consisting of O,O'-dibenzoyl-(2R,3R)-tartaric acid, a hydrate thereof or a salt thereof, and ditoluoyl-(2R,3R)-tartaric acid, a hydrate thereof or a salt thereof.

14. The method of claim 13, wherein the step (b) is carried out by heating the supramolecular assembly or contacting the supramolecular assembly with water at an elevated temperature.

15. The method of claim 14, wherein the elevated temperature is about 80° C. or higher.

* * * * *